United States Patent [19]

Stefan

[11] Patent Number: 4,911,309

[45] Date of Patent: Mar. 27, 1990

[54] STORAGE RACK FOR CYLINDRICAL CANS

[76] Inventor: Alexander Stefan, 216 E. Arby Ave., Las Vegas, Nev. 89119

[21] Appl. No.: 236,149

[22] Filed: Aug. 25, 1988

[51] Int. Cl.[4] ..... A47F 7/00

[52] U.S. Cl. ..... 211/59.2; 211/189

[58] Field of Search ..... 211/59.2, 49.1, 52, 211/59.3, 189; 312/45

[56] References Cited

U.S. PATENT DOCUMENTS

| | | | |
|---|---|---|---|
| 2,852,327 | 9/1958 | Mason | 211/59.2 X |
| 2,888,145 | 5/1959 | Knott et al. | 211/59.2 |
| 3,306,688 | 2/1967 | Domenico | 211/59.2 X |
| 4,287,992 | 9/1981 | Takemori | 211/59.2 |

*Primary Examiner*—Alvin C. Chin-Shue
*Assistant Examiner*—Sarah A. Lechok
*Attorney, Agent, or Firm*—Charles C. Corbin

[57] ABSTRACT

Disclosed is a stroage rack system for cylindrical cans which has a limted number of standardized component parts that allow assembly into a rack of any capacity desired. There are at least two rectangular panels each of which in its disassembled state has both of its major surfaces grooved with mortises. Flexible elongated moldings have tenon portions which are insertable in the panel mortises to form can-supporting rails. The assembled rack includes at least two upright panels, horizontally spaced apart and laterally aligned, with horizontally extending rod connectors supporting the panels in their spaced relationship. Shorter pairs of the flexible moldings are inserted in mortises of the upright panels to form short rail pairs and, similarly, longer pairs of the flexible moldings are inserted in the upright panels to form longer rail pairs, which longer and shorter rail pairs cooperate to provide a serpentine, downward passage for a cylindrical can placed on a shorter rail pair at the uppermost location of a shorter rail pair. Suitable stop means are provided at the front of the lowermost longer rail pair to retain cans in the rack, but the lowermost can may be readily lifted out as required.

4 Claims, 2 Drawing Sheets

FIG. 5.
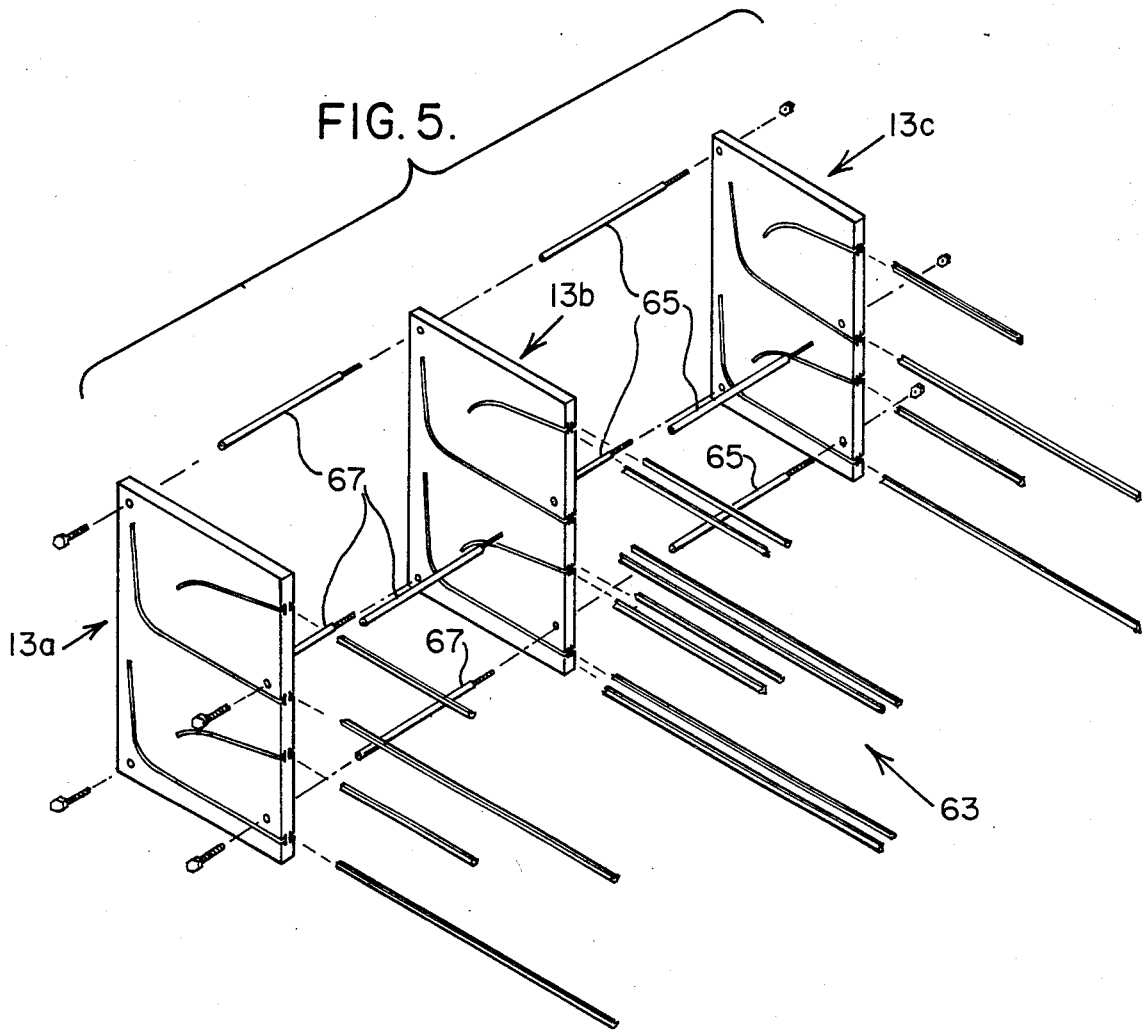
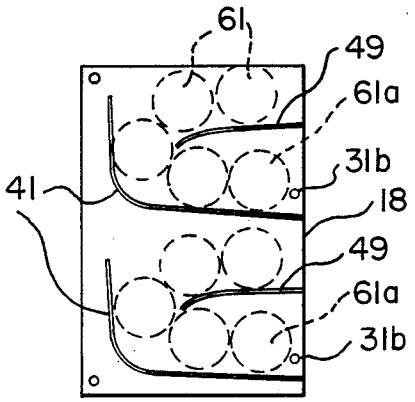
FIG. 4.

STORAGE RACK FOR CYLINDRICAL CANS

BACKGROUND

The invention relates generally to storage racks that rollingly receive a plurality of cans under gravitational urging.

Commonly available storage systems in the home are typically customized cabinets and the like, which are more suited for storing a variety of different items such as various types and sizes of cans and boxed goods. Where there is a need for storing a number of similarly sized cans, including cans of food stuffs and cans of industrial liquids such as paints, the prior systems cannot do it efficiently and in a manner which allows for quick retrieval. Further, there is need to make available such a storage system in the form of component parts that the ordinarily skilled consumer can easily assemble into a storage rack.

SUMMARY OF THE INVENTION

In view of the foregoing it is an object of the present invention to make available to the ordinarily skilled consumer a fairly inexpensive storage system for cans that he can assemble on his own.

Another object of the invention is to provide a storage rack system that has a few standardized components.

A further object of the invention is to provide a storage rack system with a capacity that can be increased, as required, by the addition of standard components to the existing rack.

A still further object is to provide a storage rack for cans that is space-efficient and which permits quick retrieval.

These and other objects and advantages will be recognized by those of ordinary skill in the art by reference to the present invention as described in the following summary, detailed description and claims.

Accordingly the present invention provides a storage rack for a plurality of cylindrical cans, which rack includes at least two rectangular upright support panels of equal dimensions, horizontally spaced apart and laterally aligned with the major sides of each panel in parallel with the major sides of adjacent panels. There are rod-like horizontal stringers that hold the panels in their spaced relationship. The invention includes a first, laterally aligned long rail pair with one long rail of the pair mounted to a major side of a first support panel and the other long rail mounted to an opposing side of a second, adjacent panel. These long rails extend from the front edge of the panels substantially towards the rear edge of the panels at a slight upward incline and then curve upwardly to a substantially vertical orientation, and are adapted to rollingly support a can placed thereupon.

The invention also features a first, laterally aligned short rail pair that is mounted to the sides of the first and second support panels. The front ends of this short rail pair are spaced at least a can-passing distance above the front ends of the long rail pair, and these short rails extend rearwardly at a slight decline towards rear portions that curve downwardly and terminate at a certain spacing from the curved portions of the long rails. This construction is such that a can, laid on its curved side upon the front of the short rail pair, will roll rearwardly therealong and be carried into engagement with the curved portion of the long rail pair and then forwardly therealong into stopping engagement with one of the horizontal stringers positioned at the front of the long rail pair to function also as a retaining bar. A series of cans placed on the short rail pair will similarly be guided along the rails and stored in a stack that extends from the front of the long rails to the front of the short rails. This arrangement also provides for gravity-fed dispensing of cans from the front of the long rails.

Invention also lies in the providing of a unique combination of component parts that are structured so that the layman may easily assemble the subject storage rack. Thus the invention provides a support panel which has mortises in both its major surfaces, which mortises follow paths corresponding to those of the above-defined short and long rails. The invention also includes two standard lengths of relatively flexible elongated polymeric members that have tenon portions that will engage the mortises of the support panels. The shorter ones of these members are insertable in a panel mortise to form the short rail pairs and similarly the longer members will form the long rail pairs.

BRIEF DESCRIPTION OF THE DRAWINGS

FIG. 4 is a side elevational view illustrating how cans are stored and dispensed; and FIG. 5 is an exploded perspective view illustrating the storage rack system of the invention.

DETAILED DESCRIPTION

Figure 1:
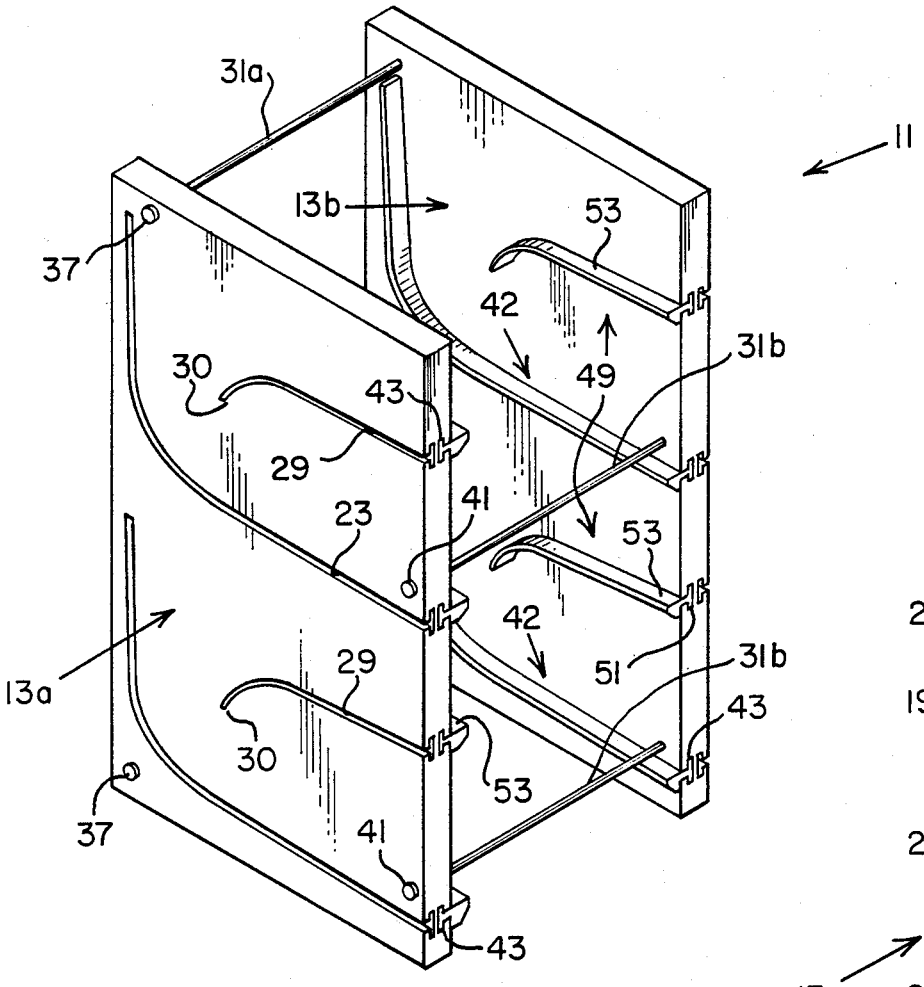
FIG. 1 is a perspective view showing a storage rack for cans, constructed according to the invention.
Figure 2:
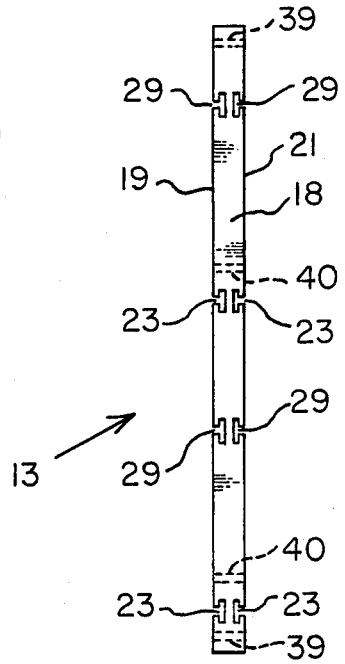
FIG. 2 is a side elevational view of a storage rack panel accoreding to the invention.

Referring now to the drawings, FIG. 1 shows a preferred embodiment of the invention in the form of a storage rack 11 that includes a first rectangular support panel **13*a* and a second, identically constructed support panel 13*b*. FIG. 2 illustrates that a typical panel 13, which is preferably constructed of wood, has front edge 18, a first major side 19 and a second major side 21. By means of techniques well known in the woodworking industry, long mortises 23 are cut into both sides of panel 15. Each mortise 23 follows a path rearwardly from the front edge 18, which path is slightly inclined upwardly for a substantial portion of the depth of panel 13, and then curves upwardly into a vertical portion as best shown in FIG. 4. There is a second, shorter mortise 29 of identical cross-sectional configuration to mortise 23, which mortise 29 follows a path from the front edge 18 that is slightly downwardly inclined, with a downwardly curved rear portion ending at end 30**.

Figure 3:
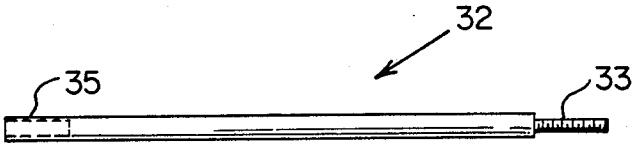
FIG. 3 is an enlarged view showing a stringer rod of the invention.

Rod-like stringers **31*a* are affixed to the rear portions of panels 13*a* and 13*b*, and identical stringers 31*b* are attached to front portions of these panels to secure them in spaced relationship. FIG. 3 illustrates a typical stringer 32 having a threaded male portion 33 and a female end 35. Bolts 37 pass through holes 39 in panel 13*a* to secure ends 35 of stringers 31*a* and 31*b*. The male portions 33 pass through holes 39 in panel 13*b* and are secured by nuts (not shown). The stringers 31*b* are similarly affixed through holes 40 in both panels by bolts 41 and nuts (not shown). It is noted that the front stringers 31*b* are spaced somewhat above the front ends of the mortises 23, so as to provide for the can-retaining function of stringers 31*b*, which is described later by reference to FIG. 4. It will also become evident that stringers 31***b* should be sufficiently below the front ends of mortises 29 to allow for a can to be comfortably carried therebetween.

Long rails 42, which are flexible polymeric moldings having tenon portions 43, are mounted in the long mortises 23, and provide can-supporting portions 45. This is accomplished simply and quickly by insertion by hand. Similarly the short rail moldings 49, having tenon portions 51, are mounted in the short mortises 29, and provide can-supporting portions 53. Here it is noted that the spacing between the short mortise end 30 and the long mortise 23 is sufficient to pass a can.

It is evident by reference to FIG. 4 that a can placed on short rail 49 will roll rearwardly therealong and be delivered to the rear of rail 41, and then will be urged forward by gravity to the retaining bar 31*b*. FIG. 4 also illustrates how a number of cans 61 can be stored on rack 11. The forwardmost cans 61*a* may be removed from storage simply by grasping it and manipulating it over the retaining bar 31*b*.

As part of a storage system the rack 11 can be augmented to increase total storage capacity by adding a third panel 13*c* if desired, as suggested by the example of FIG. 5. Note here that both sides of panel 13*b* are equipped with molded rails and the female ends of stringers 65 are conveniently engagable by the male portions of stringers 67.

While particular embodiments of the invention have been described herein it is not intended that the invention be limited thereto, since various modifications and changes may readily occur to those skilled in the art without departing from the invention. Therefore it is aimed to cover all such changes and modifications as fall within the true spirit and scope of the invention as defined in the claims which follow.

What is claimed is:

1. Storage rack system for holding a plurality of cylindrical cans, including:

(a) at least two rectangular support panels of equal dimensions, each of said panels having a first and a second major surface, and each of said panels having at least one set of a long mortise and a short mortise provided in both of said major surfaces of each said panels, and each long and short mortise on said first major surface of said panel lying opposite a long and short mortise respectively, on said second major surface of said panel, and when viewing one of said panels in upright position, each of said long mortises extending from the front edge of said panel substantially towards the rear edge of said panel at a slightly upward incline and then curving upwardly to a substantially vertical orientation; and each of said short mortises extending from the front edge of said panel, at a distance above the front end of said long mortise sufficient to pass one of said cans, and rearwardly at a slight decline towards a rear portion that curves downwardly to terminate at a spacing from the curved portion of said long mortise sufficient to pass one of said cans;

(b) first relatively flexible elongate polymer molding, having a tenon portion on one side and a portion with a flat upper surface on the side opposite said one side, said first molding being insertable in said short mortise to form a first rail;

(c) second relatively flexible elongate polymer molding having a tenon portion on a first side and a portion with a flat upper surface on the side opposite said first side, said second molding being insertable in said long mortise to form a second rail; and (d) plurality of rod-like connectors affixable through holes in said at least two panels at right angles to said panels, whereby said at least two panels may be held upright in spaced-apart parallel relationship.

2. System as defined in claim 1 wherein the front end of each said connectors is adapted to be affixed to the rear end of each of said connectors.

3. Storage rack according to claim 1 whereby one of said cans placed upon said short rail pair will roll rearwardly therealong under force of gravity and be guided into engagement with the rear portion of said long rail pair, along which said can will roll forwardly towards engagement with said retaining means.

4. Storage racks according to racks according to claim 1 including at least a second laterally aligned long rail pair configured identically to said first long rail pair, and at least a second laterally aligned short rail pair, said second long and short pairs mounted to said first and second support panels at a predetermined spacing above said first rail pairs.

* * * * *